United States Patent [19]

Gelbard

[11] Patent Number: 4,535,600

[45] Date of Patent: Aug. 20, 1985

[54] TEMPERATURE CONTROL FOR A CYCLE DEFROST REFRIGERATOR INCORPORATING A ROLL-BONDED EVAPORATOR

[75] Inventor: Robert B. Gelbard, Louisville, Ky.

[73] Assignee: General Electric Company, Louisville, Ky.

[21] Appl. No.: 600,986

[22] Filed: Apr. 16, 1984

[51] Int. Cl.[3] ..... F25D 21/06

[52] U.S. Cl. ..... 62/156; 62/227; 62/285

[58] Field of Search ..... 62/156, 227, 285, 288, 62/289, 518, 519; 236/99 D, 99 R, DIG. 6; 165/11; 374/147, 148, 208

[56] References Cited

U.S. PATENT DOCUMENTS

| | | | |
|---|---|---|---|
| 2,613,509 | 10/1952 | Philipp | 62/518 X |
| 2,672,023 | 3/1954 | Jacobs et al. | 62/4 |
| 2,706,894 | 4/1955 | Shoemaker | 62/4 |
| 2,777,300 | 1/1957 | Palmer | 62/126 |
| 2,795,113 | 6/1957 | Wurtz | 62/4 |
| 2,795,117 | 6/1957 | Herndon, Jr. et al. | 62/103 |
| 2,966,781 | 1/1961 | Schaefer et al. | 62/523 |
| 2,979,922 | 4/1961 | DeWitte et al. | 62/447 |
| 3,717,009 | 2/1973 | Butts | 62/523 |
| 4,165,733 | 8/1979 | Middleton et al. | 126/420 |

*Primary Examiner*—Harry Tanner

*Attorney, Agent, or Firm*—Frank P. Giacalone; Radford M. Reams

[57] ABSTRACT

A temperature control system for a refrigerator including a roll-bonded evaporator in the fresh food compartment in which is formed a non-refrigerant carrying passageway extending the full width of the evaporator. A temperature control located in the compartment includes a temperature sensitive capillary tube portion extending substantially the full length of the passageway so as to be subjected to the limited environment of the passageway and accordingly responsive to the true temperature of the evaporator.

8 Claims, 4 Drawing Figures

TEMPERATURE CONTROL FOR A CYCLE DEFROST REFRIGERATOR INCORPORATING A ROLL-BONDED EVAPORATOR

BACKGROUND OF THE INVENTION

The present invention relates to cycle defrost refrigerator wherein defrost of the fresh food compartment evaporator is accomplished during the compressor OFF cycle primarily by convection of the relatively warm above freezing fresh food compartment air and through the heat leakage entering the fresh food compartment and more particularly to a control system for a cycle defrost refrigerator incorporating a roll-bond evaporator.

Generally in a cycle defrost refrigerator the temperature of the fresh food compartment is maintained by sensing the true temperature of the evaporator. This requires that the entire length of the thermostat control capillary tube be maintained in heat exchange relationship with the evaporator. Traditionally many cycle defrost refrigerators suffer from the inability of the control capillary to sense the true fresh food evaporator conditions under critical usage conditions. This often results from the inconsistencies of arranging the control capillary tube relative to the fresh food evaporator so that it will sense accurate evaporator conditions. These control errors often result in residual icing problems, premature compressor trip-offs, and a wide dispersal of operating response characteristics. One common manner of securing the control capillary to the evaporator to insure that the full length of the capillary tube is in contact with the evaporator has been to employ a plurality of clamps spaced along the entire length of the capillary tube. This method requires the use of external parts and labor to secure them to the evaporator and falls short of solving the problem since the relatively small diameter capillary tube realistically cannot conform to the surface of the evaporator.

SUMMARY OF THE INVENTION

An object of the present invention is to provide a passageway which extends across the full width of the roll-bonded plate evaporator and whose cross-sectional area assures introduction of the capillary tube to a position occupying the full length of the passageway so that it is in contact with the walls of the passageway.

By the present invention there is provided in a houshold refrigerator having an upper low temperature food compartment and a lower relatively high temperature food compartment including a one-piece evaporator for refrigerating the compartments. The one piece evaporator is formed of a pair of sheets roll-forged together to include liquid carrying conduits between the sheets. The evaporator has a first section located in the low temperature compartment and a second section arranged substantially vertically in the relatively high temperature compartment and connected to the first section by means of a relatively narrow neck portion. A hermetic compressor supplies liquid refrigerant to the liquid carrying conduits in the evaporator sections in series and for withdrawing evaporated refrigerant therefrom. Located in the high temperature compartment is a temperature control means including a temperature sensitive capillary tube portion. A passageway is formed between the pair of sheets of the second section of the evaporator. The passageway is located below the liquid carrying conduits and extends between the vertical edges of the second section. The passageway has a cross-sectional area which is dimensioned to allow easy insertion of the capillary tube to a position where it occupies substantially the full length of the passageway while at the same time insuring accurate thermal response between the temperature sensitive capillary tube portion and passageway walls so that the capillary tube portion is subjected to the limited environment of the passageway and accordingly the true temperature of the second section of the evaporator.

BRIEF DESCRIPTION OF THE INVENTION

Figure 1:
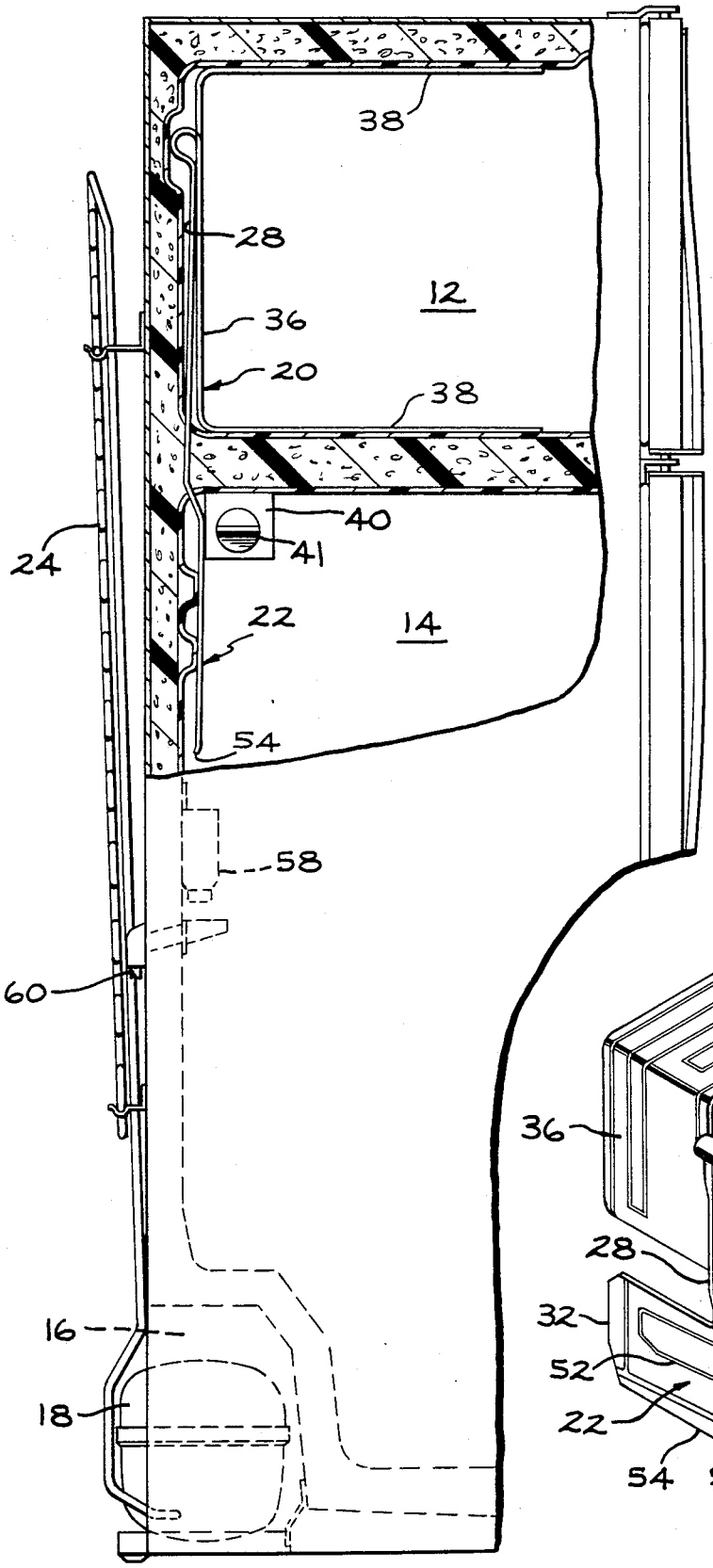
FIG. 1 is a sectional view of a two compartment refrigerator incorporating the present invention.

Referring now to the drawing wherein a preferred embodiment of the invention has been shown, reference numeral 10 generally designates a conventional insulated refrigerator cabinet having a below freezing frozen food compartment 12 disposed in the upper part of the cabinet, an above freezing main food storage compartment 14 disposed below the freezer compartment 12, and a machinery compartment 16 arranged in the bottom portion of the cabinet. The frozen food compartment 12 is adapted to be maintained at a temperature low enough to properly preserve frozen food for long periods of time. Thus, the temperature therein is preferably maintained somewhere between −10° F. and 10° F. The main food storage compartment 14 is preferably maintained at temperatures above freezing but low enough to properly refrigerate perishable unfrozen foods. It has been found that temperatures in the range of 37° to 40 20 F. are most satisfactory for this purpose.

The compartments 12 and 14 are refrigerated by a one-piece roll-forged evaporator including evaporators sections 20 and 22 respectively which are connected in series flow in the refrigerant circuit. The refrigerating system used for maintaining the compartments 12 and 14 within the desired temperature ranges mentioned above employs a conventional motor compressor unit 18 which is adapted to be mounted in the machinery compartment 16 and which discharges compressed refrigerant into the condenser 24 positioned across the outside back wall of the refrigerator. Condensed liquid refrigerant from the condenser 24 then flow thru a conventional capillary tube (not shown) to the evaporator section 20 located in the freezer compartment and then to the series connected evaporator section 22 located in the food storage compartment 14.

Figure 4:
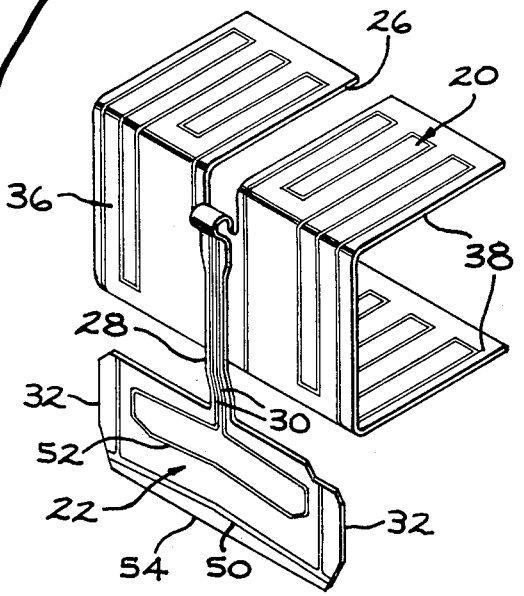
FIG. 4 is a diagramatic showing of the one-piece two-section evaporator incorporated in the embodiment of the present invention.
Figures 2, 3:
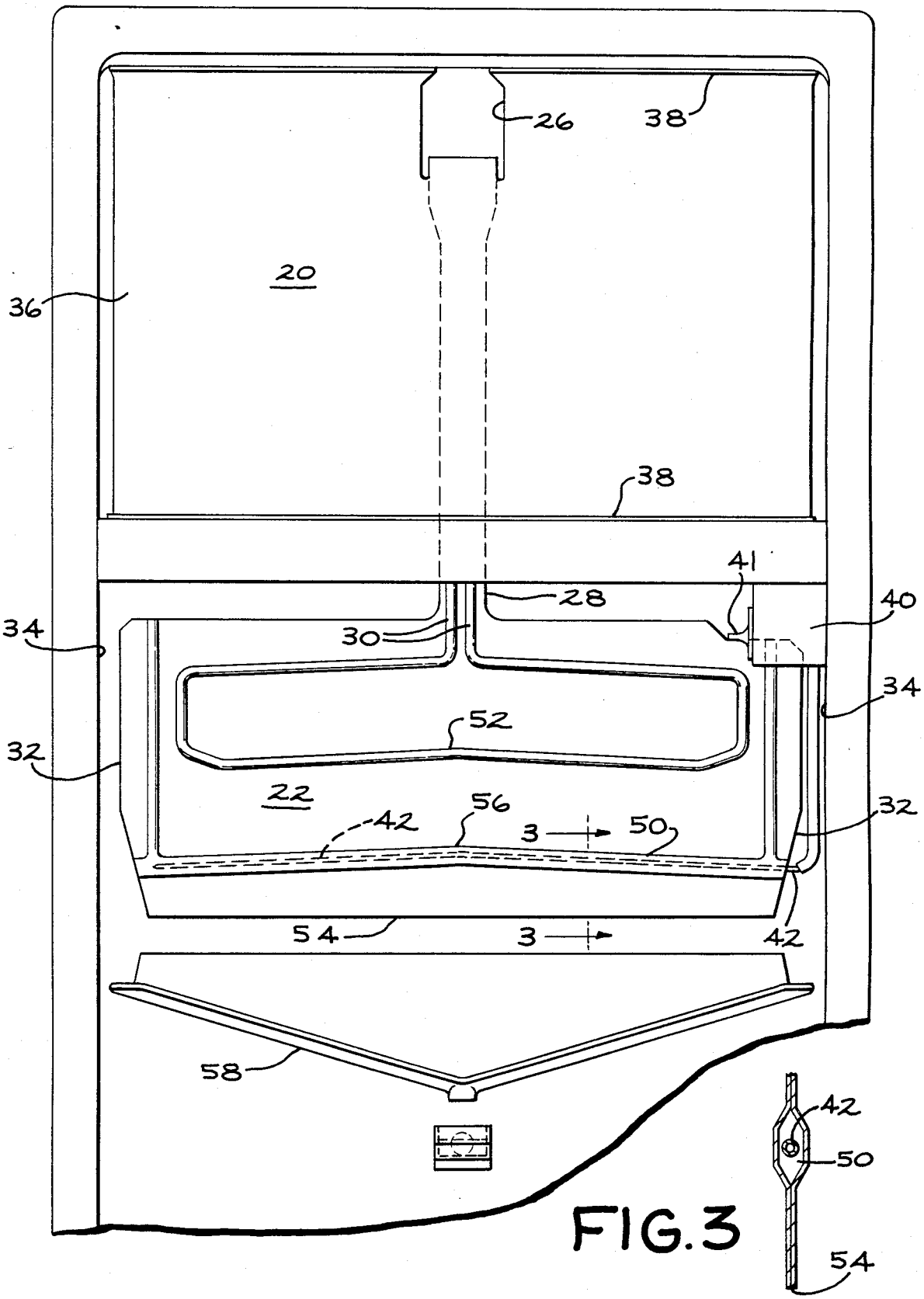
FIG. 2 is a partial front elevational view with the cabinet door removed showing the lower compartment evaporator incorporating the present invention.
FIG. 3 is an enlarged cross-sectional view along line 3—3 of FIG. 2 showing the arrangement of the control tube in conjunction with the illustrated embodiment of the present invention.

The evaporators sections 20 and 22 are fabricated from two superimposed planar sheets made in one piece by a roll-forging operation. While the present invention does not reside in a roll-forging method as such, a brief general description of this method is included in order to facilitate a complete understanding of all aspects of the invention. The pair of sheets are superimposed upon one another with a pattern of stop-weld material coated on the one sheet. The stop-weld material provided between the sheets prevents the sheets from adhering to one another throughout the coated area. Following the roll-forging operation fluid under pressure is supplied between the sheets so as to dilate the sheets for the purpose of forming refrigerant passages corresponding to the pattern of the stop-weld material. The stop-weld material is so applied that the internal refrigerant passages extend throughout the major portion of the plate and in effect form two spaced evaporator sections connected in series refrigerant flow relationship. A slot 26 is cut in the composite plate after the roll-forging operation as shown in FIG. 4 so as to separate the evaporator section 20 from evaporator section 22 except at the narrow neck 28. This narrow neck 28 includes a refrigerant passages 30 (FIGS. 2 & 4), which connects the evaporator section 20 in series with the evaporator section 22. In installing the evaporator sections 20 and 22 in the cabinet the evaporator section 22 may be arranged as shown in FIG. 2 with its vertical side edges 32 adjacent to side walls 34 of the food storage compartment cabinet and substantially parallel to the rear wall of compartment 14 as shown in FIG. 1. The evaporator section 20 as best shown in FIGS. 1 and 4 is folded into a U-shape configuration including a back wall 36 and horizontally extending top and bottom walls 38. It should be noted that other configurations of the freezer compartment evaporator may be used in conjunction with the present invention.

The temperature of the fresh food compartment 14 is regulated by a thermostatically operated temperature control 40 mounted on one side wall 34 in the compartment 14. The control 40 includes a manually adjustable control knob 41 used to select the fresh food compartment temperature and a control capillary tube 42 arranged as will be explained fully to be in contact with the lower portion of the evaporator section 22. The control 40 is used for starting and stopping the motor compressor unit 18 in response to the selected refrigeration requirements. The control 40 is of the type which is adapted to close the circuit to the motor compressor unit 18 when the temperature of the coldest portion of the control capillary 42 is a few degrees above the melting temperature of the frost which may form on the evaporator section 22 during the "ON" cycle of the compressor and is adapted to open the circuit to the compressor when the temperature of the coldest portion of the control capillary 42 approaches the selected evaporator OFF temperature. The relative sizes of the evaporators 20 and 22 and the arrangement of the passages therein are such to provide for automatic defrosting of the evaporator section 22 during the OFF cycle without defrosting the evaporator section 20. It is important to note that the control capillary 42 responds to evaporator temperatures rather than the temperature of the air in the food compartment as it has been found that the temperature of the air in the food storage compartment may be maintained substantially between 37° and 40° F. at all times even though the temperature of the evaporator 22 sensed by the bulb 42 fluctuates over a wide range such as −6° F. to 37° F. The temperature values given herein are primarily for purposes of illustration and may be varied to suit different requirements.

In order for the capillary tube 42 to respond to true evaporator temperature rather than air temperature and to obtain accurate temperature control it must control from the coldest point. In conventional practice this can only be accomplished if the capillary tube is securely and accurately positioned to be in direct contact with the evaporator surface over its full intended sensing contact area or length. To obtain uniform temperature calibrations for a multitude of cabinets of the same type, it is necessary that the same predetermined length of control bulb be arranged in heat exchange relationship with the evaporator wall in each cabinet and that this entire length be in heat relationship with the evaporator.

By the present invention the capillary tube 42 is positioned so as to respond to true evaporator conditions. To this end an open non-refrigerant passageway 50 is formed in the evaporator section 22. The passageway 50 as seen in FIG. 2 is positioned below the lowermost refrigerant pass 52 and the lower edge 54 of the evaporator 22. The passageway 50 extends across the full width of the evaporator and diverges downwardly and outwardly from a central apex 56. The capillary tube 42 is inserted the full length of the passageway 50 as shown by broken lines in FIG. 2 so as to be exposed to temperatures across the full width of the evaporator. For example, the temperature in the inlet area of refrigerant pass 52 might be different than that in outlet area of pass 52.

The length and cross-sectional area of the passageway 50 relative to the diameter and length of capillary tube 42 is such that the capillary tube 42 may be easily inserted therein while at the same time insuring that a thermal relationship is maintained between the capillary and evaporator. The capillary 42 is so positioned in the passageway 50 that it sees only the limited environment generated by the highly conductive walls of the passageway. In the control employed in carrying out the present invention the capillary controls from the coldest point along its length. The arrangement of the capillary and passageway extending across the evaporator insures that Off cycle will be initiated from coldest point along the width of the evaporator which is below freezing and an ON cycle which is initiated from the coldest part of the evaporator which is above the freezing temperature. The passageway 50 as stated above in effect creates an environment in which the capillary tube 40 can sense the true temperature of the evaporator.

By the present arrangement a constant temperature difference between the control capillary and the evaporator is generated which insures a consistent refrigeration cycle initiation and termination with respect to true evaporator conditions such as overall average temperature and frost conditions.

The capillary tube due to its location below the lowest refrigerant carrying pass senses the descending defrost water which impinges on the outer surface of the passageway. The above freezing temperature of the defrost water contacting the passageway 50 influences the temperature of the evaporator and accordingly the temperature sensed by the capillary tube 42. Defrost water impinging on the passageway 50 tends to flow downwardly toward the outer edges 32 and into trough 58 where it flows into a drain tube 60 to be disposed of by evaporation in the machine compartment 16 in any suitable manner (not shown).

While in the embodiment shown a single or one-piece evaporator is shown it should be noted that evaporator sections 20 and 22 may be separately formed and connected by appropriate refrigerant tubing.

Further, the passageway 50 may be formed by brazing or adhesively bonding a tube member to the plate evaporator. A tube so bonded to the evaporator would create the same environment for the capillary tube as formed passageway 50 does in that the capillary would still be in a position to sense true evaporator temperature.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A cycle defrost household refrigerator including a cabinet having an upper lower temperature food compartment and a lower relatively high temperature food compartment, evaporator means for refrigerating said compartments comprising:

a first evaporator located in said low temperature compartment and a second evaporator arranged substantially vertically in said relatively high temperature compartment and connected to said first evaporator in series refrigerant flow relationship;

means for supplying liquid refrigerant to said liquid carrying conduits in said first and second sections in series and for withdrawing evaporated refrigerant therefrom;

a temperature control means in said high temperature food compartment including a temperature sensitive capillary tube portion having a length corresponding substantially to the width of said second evaporator;

said temperature control being operable by the coldest temperature sensed along the length of said capillary for causing said compressor to cycle off to cause defrosting of said section of said evaporator;

a passageway positioned in heat exchange relationship to said second evaporator extending substantially the entire width between the vertical sides thereof;

said passageway having a cross-sectional dimension for allowing insertion of said capillary tube portion to a position substantially the full length of said passageway and for insuring thermal relationship between said capillary tube portion and said passageway so that said capillary tube portion is subjected to the limited environment of said passageway and the temperature of said second section.

2. The household refrigerator recited in claim 1 wherein said passageway is arranged below the liquid carrying conduits.

3. The household refrigerator recited in claim 2 wherein said passageway is formed to include a central apex from which said passageway extends downwardly and outwardly.

4. The household refrigerator recited in claim 3 wherein there is further provided a drain means located below said passageway for receiving defrost water from said second section of said evaporator.

5. A cycle defrost household refrigerator including a cabinet having an upper low temperature food compartment and a lower relatively high temperature food compartment, evaporator means for refrigerating said compartments comprising:

a one piece evaporator formed of a pair of sheets roll-forged together to include liquid carrying conduits between said sheets, said evaporator having a first section located in said low temperature compartment formed in a U-shape to include a back wall portion having substantially horizontally extending upper and lower wall portions and having a second section arranged substantially vertically in said relatively high temperature compartment and connected to said first section by means of a relatively narrow neck portion;

means for supplying liquid refrigerant to said liquid carrying conduits in said first and second sections in series and for withdrawing evaporated refrigerant therefrom;

a temperature control means in said high temperature food compartment including a temperature sensitive capillary tube portion having a length corresponding substantially to the width of said second evaporator.

said temperature control being operable by the coldest temperature sensed along the length of said capillary for causing said compressor to cycle off to cause defrosting of said section of said evaporator.

a passageway formed between the pair of sheets of said second section extending substantially the entire width between the vertical sides thereof;

said passageway having a cross-sectional dimension for allowing insertion of said capillary tube portion to a position substantially the full length of said passageway and insuring thermal relationship between said capillary tube portion and said passageway so that said capillary tube portion is subjected to the limited environment of said passageway and the temperature of said second section.

6. The household refrigerator recited in claim 5 wherein said passageway is arranged below the liquid carrying conduits.

7. The household refrigerator recited in claim 6 wherein said passageway is formed to include a central apex from which said passageway extends downwardly and outwardly.

8. The household refrigerator recited in claim 7 wherein there is further provided a drain means located below said passageway for receiving defrost water from said second section of said evaporator.

* * * * *